United States Patent [19]

Knickerbocker

[11] Patent Number: 4,575,177

[45] Date of Patent: Mar. 11, 1986

[54] MULTIPLE ELECTRICAL CONNECTOR AND MOUNTING BLOCK WITH BOOTS

[75] Inventor: Robert H. Knickerbocker, Cheshire, Conn.

[73] Assignee: The Siemon Company, Watertown, Conn.

[21] Appl. No.: 537,068

[22] Filed: Sep. 29, 1983

[51] Int. Cl.[4] ..... H01R 9/00; H01R 4/02

[52] U.S. Cl. ..... 339/198 R; 339/97 R

[58] Field of Search ..... 339/97 R, 97 P, 98, 339/99 R, 198 R, 198 S

[56] References Cited

U.S. PATENT DOCUMENTS

| | | | |
|---|---|---|---|
| 3,112,147 | 11/1963 | Pferd et al. | 339/198 R |
| 3,132,913 | 5/1964 | Pohl | 339/97 P |
| 4,150,867 | 4/1979 | Knickerbocker | 339/97 P |
| 4,381,880 | 5/1983 | Pohl | 339/210 M |
| 4,408,391 | 10/1983 | Pohl | 29/861 |
| 4,425,019 | 1/1984 | Pohl | 339/97 R |

FOREIGN PATENT DOCUMENTS

| | | | |
|---|---|---|---|
| 2461374 | 3/1981 | France | 339/97 R |

*Primary Examiner*—Gil Weidenfeld
*Assistant Examiner*—Gary F. Paumen
*Attorney, Agent, or Firm*—Fishman & Dionne

[57] ABSTRACT

A mounting block for solderless connectors has a retainer and a body section which defines slots for housing terminal defining conductive elements. Incorporated on the body section is a novel wire retaining mechanism comprising a plurality of boots or hoods. Each boot or hood has a hook shape, the end of which preferably faces inwardly towards the middle of the terminal block.

5 Claims, 8 Drawing Figures

MULTIPLE ELECTRICAL CONNECTOR AND MOUNTING BLOCK WITH BOOTS

BACKGROUND OF THE INVENTION

This invention relates to the field of multiple electrical connectors and mounting blocks therefor. More particularly, this invention relates to a new and improved mounting block for wire formed solderless multiple connectors of the type shown in my prior U.S. Pat. No. 4,381,880, all of the contents of which are incorporated herein by reference.

U.S. Pat. No. 3,132,913 relates to a solderless multiple connector formed from continuous strips of wire formed and shaped in adjacent and abutting loops so as to receive and electrically contact electrically conductive wire between abutting sections of loops. The wire formed solderless connector shown in U.S. Pat. No. 3,132,913 was intended as an improvement on and had several advantages over prior art clip type connectors of the type generally shown in U.S. Pat. No. 3,112,147 and which are sometimes referred to in the art as "66 Type" connectors.

U.S. Pat. No. 4,381,880 is an improvement over deficiencies in U.S. Pat. No. 3,132,913. U.S. Pat. No. 4,381,880 relates to a mounting block for solderless connectors having a retainer and a body section which defines slots for housing terminal defining conductive elements. These conductive elements are formed from wire to define linearly aligned plural loops between which wires may be inserted. The conductive elements are arranged in uniformly spaced horizontal rows and vertical columns of terminals.

A troublesome problem has been associated with the multiple electrical connector and mounting block as disclosed in U.S. Pat. No. 4,381,880. This problem relates to the wings located on top of the bridge members. These wings act as a lead-in area or ramp to guide an electrical conductor wire into position for insertion in the connector block. Each wing terminates in a downwardly pointed end surface which serves as a retention mechanism to hold the electrical wire in place in anticipation of connection to the wire formed connector strip. The retention is accomplished due to the fact that the insulation covering the wires is slightly compressed as it passes through the opening defined by the wings between adjacent bridges, and the pointed ends frictionally engage and retain the outer insulation of the wire.

Unfortunately, although the wire retaining wings have performed their desired retention functions, this performance has not been completely acceptable and therefore an improved retaining means would be appreciated.

SUMMARY OF THE INVENTION

The present invention meets the needs discussed above by providing a novel and improved solderless connector of the multiple terminal type.

Solderless connector blocks in accordance with the present invention have incorporated therein a plurality of wire retaining hoods or boots on the top portion of the bridges in the terminal block. Unlike the prior art wing retention mechanism, the present invention employs the more efficient and workable boot conductor wire retainers. These boots are shaped like small hooks and face inward toward the middle of each terminal block. The hoods are spaced above and extend over an adjoining bridge to define a novel wire connector lead-in area and wire retaining means.

Other advantages of the present invention will be apparent to and understood by those skilled in the art by the following detailed description and drawings.

DESCRIPTION OF THE DRAWINGS

Referring now to the drawings, wherein like elements are numbered alike in the several FIGURES.

DESCRIPTION OF THE PREFERRED EMBODIMENT

Figure 1:
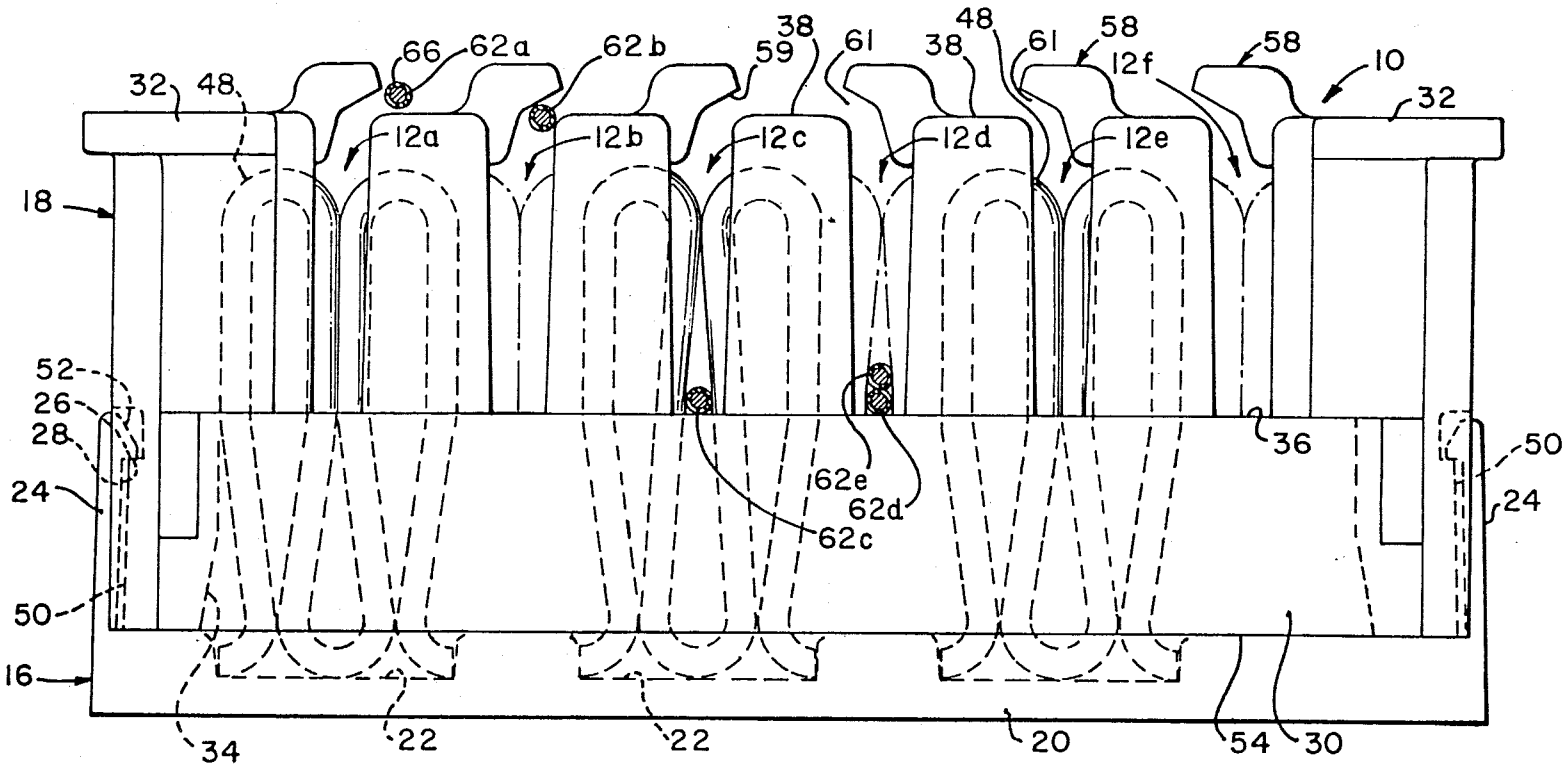
FIG. 1 is a front elevation view of the mounting block of the present invention.
Figure 2:
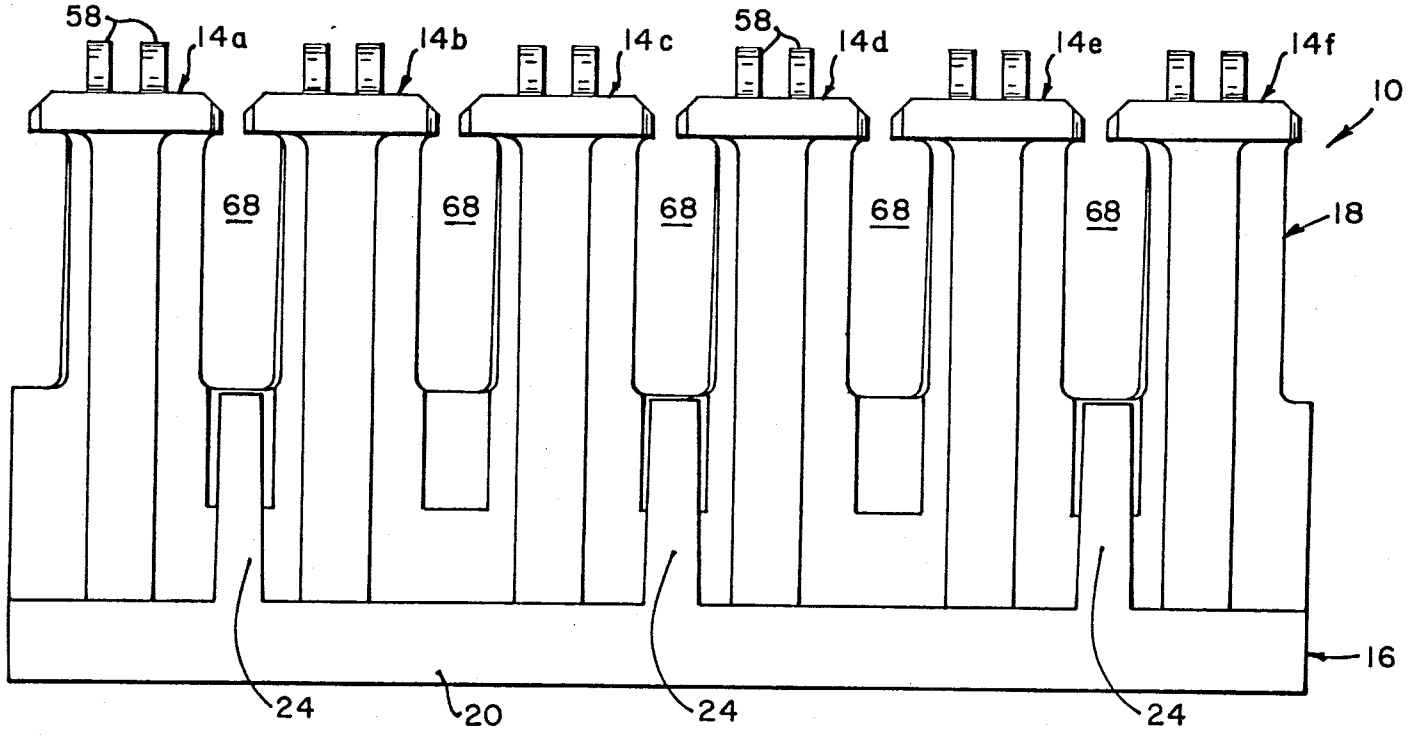
FIG. 2 is a side elevation view of the mounting block of FIG. 1.
Figure 3:
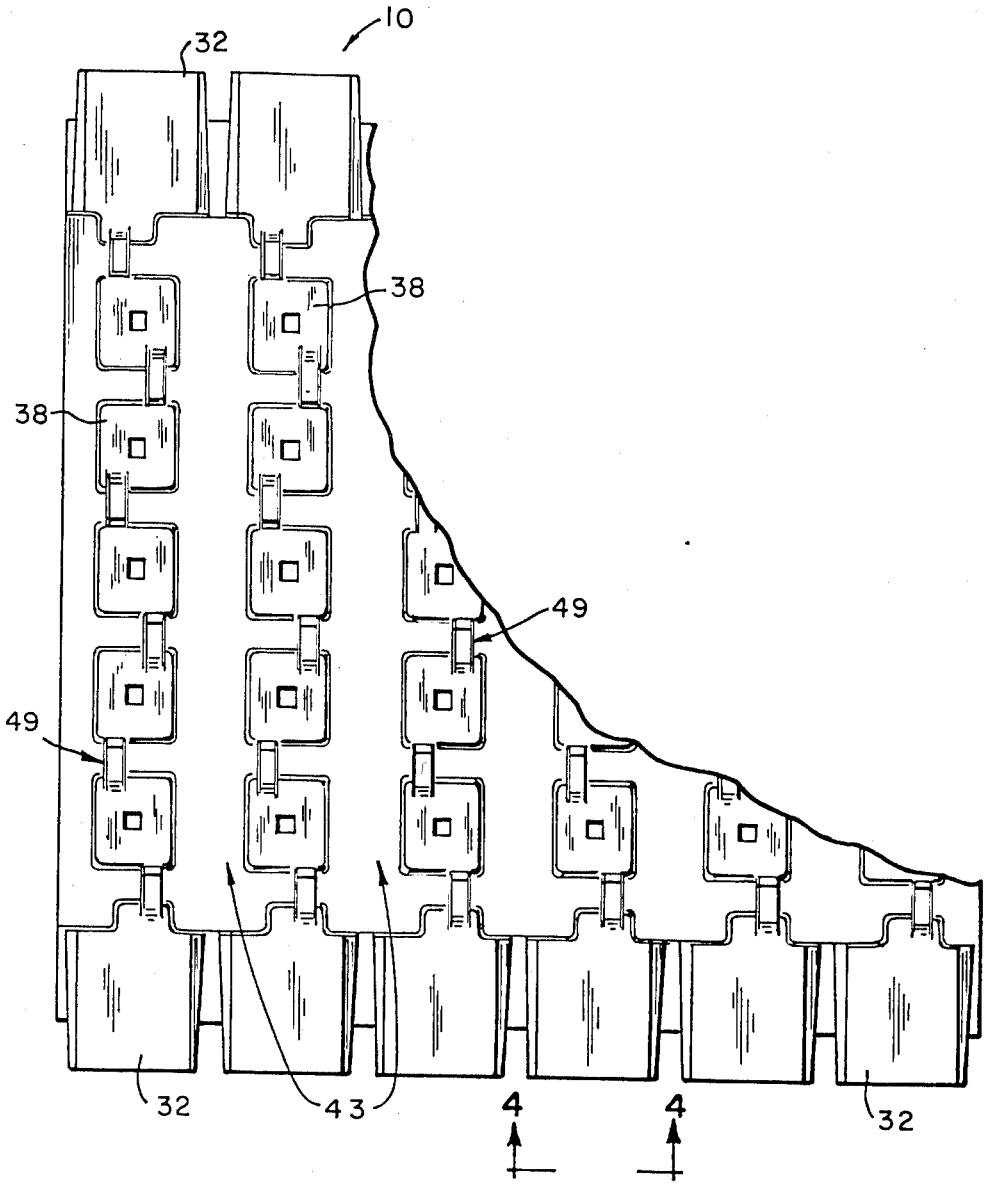
FIG. 3 is a partial top plan view of the mounting block of the present invention.

FIGS. 1, 2 and 3 show a block, generally indicated at 10, for 36 connector locations, arranged in six by six array. That is, front to back of the block there are six columns of individual connector locations, each of which has six rows of individually staggered connector locations from side to side. While the details which make up these six columns and six rows will be discussed in more detail hereinafter, the six columns are generally indicated at 12(*a*) through 12(*f*) in FIG. 1, and the six rows of staggered connector locations are generally indicated at 14(*a*) through 14(*f*) in FIG. 2. Of course, it will be understood that any desired number of rows and columns can be used, and the six by six array is merely for purposes of illustration.

Block 10 is made up of two basic interlocking parts. These two parts are a retainer 16 and a main body unit 18, both of which are molded plastic elements. For purposes of clarity and understanding, main body unit section 18 and retainer 16 are separately shown in FIGS. 1(A) and 1(B) respectively, FIGS. 1(A) and 1(B) corresponding to separate parts of the assembled unit shown in FIG. 1. Retainer 16 has a base portion 20 with a series of latitudinal (side to side) uniformly staggered or alternating slots 22 therein corresponding to the number of individual wire formed connectors to be housed in the block. Retainer 16 also has a plurality of locking arms 24 which extend upwardly from base 20 along each side of the retainer. Locking arms 24 are slightly resilient and springy, so that they can be deflected outwardly and then spring or snap back into place to lock retainer 16 and main body unit 18 together. The upper part of each locking arm 24 has an inwardly projecting locking surface or shoulder 26 to engage with and lock to a corresponding locking surface or shoulder 28 on main body unit 18.

Main body unit 18 has a main body portion 30 with a fanning strip, comprised of posts 32, running along each side, the fanning strips serving as a means of orderly entry into the block for insulated electrical wire conductors which are to be connected to solderless connectors in the block. Main body unit 18 includes, in body portion 30, a plurality of staggered latitudinal slots 34 which correspond to and are in alignment with each of the staggered latitudinal slots 22 in base 20. Body unit 18 has an internal floor or surface area 36 from which a series of inverted U-shaped bridges 38, which are integrally molded parts of main body unit 18, project. The outermost of bridges 38 are integral and coplanar with posts 32 of the fanning strip. Each bridge 38 has two overlapping passages or openings 40, each passage having an inverted U-shape, in alignment with the staggered or alternating slots 22 and 34. As will be described in more detail hereinafter, the slots 22 and 34 and the passages 40 serve to house and position the rows of staggered and alternating individual wire formed solderless connectors or terminal clips to be mounted in the block. Thus, in the embodiment shown in the drawings, there are six rows of staggered slots 22 and 34, with the passages 40 of the bridges 38 in each row being aligned with respect to the slots in each row. Each bridge 38 can be considered to be made up of a pair of uprights 42,42', each upright being a mirror image of the other, and a separating member 44. The separating member 44 forms the inner walls of the two overlapping passages 40 while the uprights 42,42' form the respective outerwalls of passages 40. A pin receiving cavity 45 is recessed between uprights 42,42' and above separating member 44 while cross-piece 47 forms a protective covering on the bridge element. It will, of course, be understood that all of the bridging elements 38 are of similar construction, so only illustrative ones are marked in the drawings. As best shown in FIG. 3, the bridges are spaced apart to define (1) spaced open rows 43 in which to run conductor wires from the fanning strips and (2) spaced open columns 49 through which access is had to connect conductor wires to the connector strips housed in the block.

In assembling a block as discussed above, individual solderless connectors 48 formed from a length of conductive wire are loaded into the alternating slots 34 and bridge passages 40 of main body unit 18. Retainer 16 is then placed in position relative to the main body unit, with the staggered slots 22 in alignment with the wire strips, and the base and main body unit are then moved together to come into locking engagement. As can best be seen in FIG. 1, the innermost extension of shoulder or surface 26 on the locking arms 24 overlaps main body surfaces 50 over which the arms must slide in assembling the unit. Thus, when assembling the unit, the inclined surfaces 52 on arms 24 will be engaged by surfaces 50, whereby the locking arms 24 are cammed and deflected outwardly as retainer 16 and main body unit 18 are moved together. When the retainer and main body unit have been positioned so that the bottom 54 of body portion 30 is adjacent to the top 56 of retainer body 20, the locking arms snap inwardly with locking surfaces 26 overlapping locking surfaces 28 to complete the assembly of the block. In this manner, the wire formed connector strips are locked and retained in place in the block and are ready to receive single or plural, insulated or bare, single conductor or stranded wires to be mounted thereon.

The uniform staggering or alternating positioning of each individual solderless connector or terminal clip 48 acts to conserve space and/or increase the density of connector sites. As shown in the FIGURES, the wire formed connectors are formed into individual connectors or terminal clips 48 and then positioned in a staggered arrangement in each row so as to overlap each successive individual connector and thereby conserve space. In fact, each individual connector can overlap an adjoining connector by at least one-half the width of a connector or terminal clip 48 (i.e., one connector loop). The only limitation on the extent of overlap is that enough room must be allowed to permit the insertion of an installing tool.

The staggering of unitary connectors also imparts an enormous degree of flexibility in designing particular circuits of connectors as well as isolating very specific interconnections. This flexibility in connecting individual connectors or terminal clip 48 is achieved by use of a bridging pin 57 to electrically connect two adjoining connectors 48. In order to effect a desired electrical link between two connectors 48, a bridging pin 57 is simply inserted into a pin receiving cavity 45 where it subsequently undergoes a frictional fit and becomes wedged between the two connectors 48. As can be best seen in FIG. 3, any two or more adjoining connectors 48 up to an entire row may be connected depending on the number of bridging pins used.

Figure 4:
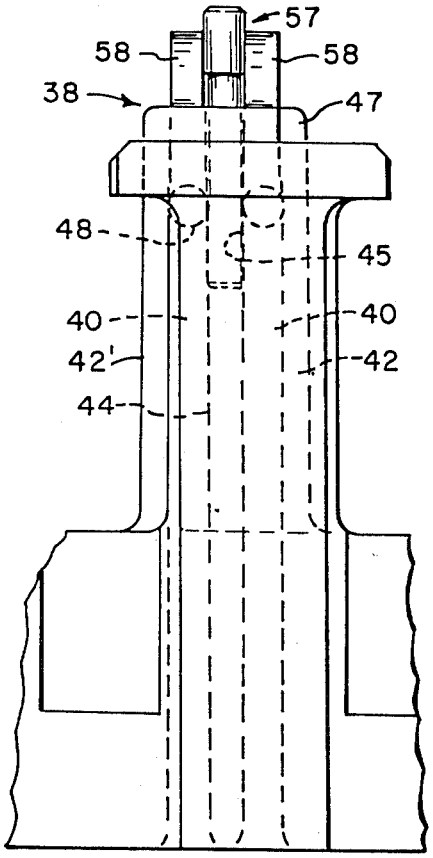
FIG. 4 is a partial sectional detail taken along line 4—4 of FIG. 3.
Figure 5A:
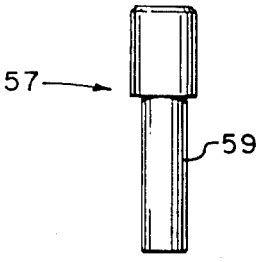
FIG. 5A is a front elevation view of a bridging pin used in accordance with the present invention.
Figure 5B:
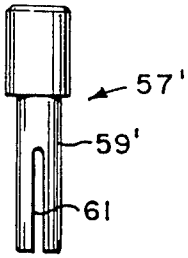
FIG. 5B is a front elevation view of another embodiment of a bridging pin used in accordance with the present invention.

Referring now to FIG. 4, an enlarged sectional view of a bridge 30 having two overlapping solderless connectors 48 therein and a bridging pin 57 mechanically wedged therebetween is shown. As thus presented, the staggered connectors 48 are electrically connected by the bridging pin 57 (see FIG. 5A). In FIGS. 4 and 5A, a preferred embodiment of a bridging pin 57 is shown, and comprises a circular shaft portion 59 having a diameter which permits insertion and frictional fit in receiving cavity 45. The shaft 59 is integrally or otherwise attached to a larger diameter head portion which permits ease of handling by the installer. FIG. 5B shows another embodiment of a bridging pin. Bridging pin 57' has essentially the same configuration as pin 57 except for the slot 61 through the bottom portion of shaft 59'. This slot 61 provides a spring or bias action to the shaft 59' resulting in a tighter, more snug frictional fit. It is obvious to one skilled in the art that a pin having any other feasible geometric configuration will serve equally as well in establishing electrical communication between connectors 48.

Referring now to FIGS. 2 and 4, each individual wire formed connector is fully retained against movement or deflection toward any adjacent connector, since the lower loops of each wire connector are fully captured in a slot 22 and the connectors are also captured in slots 34 and the bridge passages 40 in the bridges 38. Thus, each individual wire connector is fully constrained against displacement which would create misalignment and interfere with the insertion of conductor wires. Also, the bridges shield the wire connectors and prevent short circuiting by outside objects which might fall into or otherwise come into contact with the top of the block, this protection being realized without the need for a separate cover on the block.

The mounting block and retainer as described not only retains each row of wire-formed connectors against deflection toward an adjacent row, but also resists lateral deflection of eah connector row when a conductor is inserted therebetween. As clearly seen in FIGS. 1 and 2, each individual wire connector is snuggly captured within slots 34 of main body 18 and passages 40 of U-shaped bridges 38. Each upper loop of each connector wire is retained against outward movement by upright 42 and separating member 44 of bridges 38. The bridges 38 thus function to stiffen the upper loops of the connectors.

The lateral retention and stiffening of the upper loops or portions of the wire-formed connectors 48 within the blocks 10 serves an important purpose. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend.

Another important feature attributable to the above-discussed lateral retention is that the insertion of two or more conductors between a single pair of loops of the connector will not force apart the upper loop portions. This assures that the insulation will be stripped away, even after repeated use. It should thus be apparent to those skilled in the art that even after repeated use of the connectors of the present invention, there will be no outward expansion of the upper loop portions which would diminish their insulation stripping function. Also, the connector blocks of the present invention will reliably receive and retain multiple electrical conductors at each connector location.

Figure 1A:
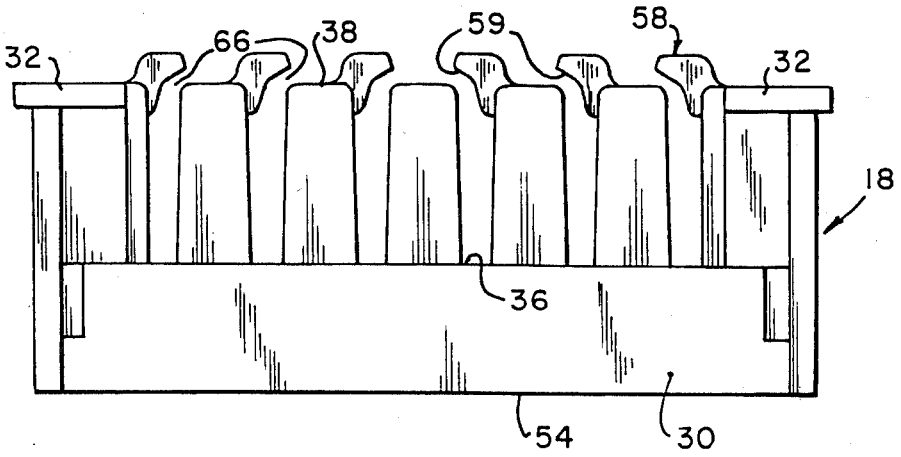
FIG. 1(A) and 1(B) are views similar to FIG. 1 showing the retainer and main body sections, respectively, of the mounting block.
Figure 1B:
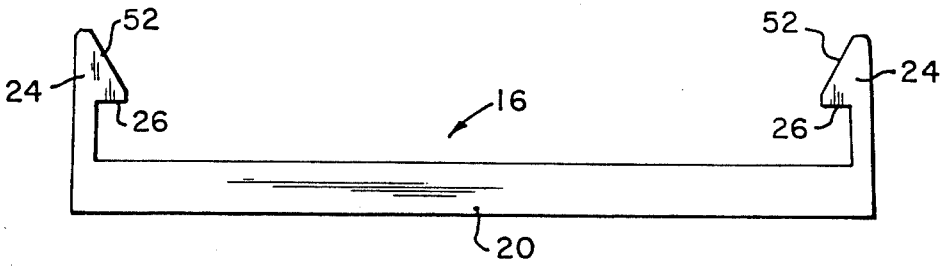

Referring now to FIGS. 1 and 1(A), an important and distinguishing feature of the present invention is illustrated by the presence of boots or hoods 58 on the top portion of each bridge 38 as shown. These boots 58 extend in a hook-like fashion from on top of each bridge 38. Each boot 58 is raised over or spaced above a particular connector 48. In a preferred embodiment, the tips of the boots or hoods 58 point towards the center of the connecting block to permit fanning from each side of the block. The upper portion of a boot 58 overhangs the top of an adjoining bridge 38 and forms a guide ramp 59 capable of accepting and retaining an electrical conductor in order to position it prior to connection with a clip or connector 48. Illustrative insulated conductors which have been guided into place for eventual insertion and connection to a row connector are shown at 62(*a*)–62(*e*) in FIG. 1. As can also be seen in FIG. 1(A), each boot 58 forms a quickly diverging guide ramp 59 which serves as a retention mechanism to hold the electrical wire in place in anticipation of connection to the wire formed connector clip 48. This retention mechanism is effected due to the fact that the opening 61 between a bridge and adjacent boot is slightly narrower than the thickness of the wire (with insulated coating). Thus, the insulation covering 66 on wires 62(*a*)–62(*e*) is slightly temporarily compressed as it passes through the opening defined by the boot and adjacent bridge. Thus, the wires are retained in place. An important feature of the boots or hoods 58 of the present invention resides in the fact that a conductor to be inserted in the connector 48 can be placed in the block in anticipation of eventual connection, and will be relatively firmly retained in place until the insertion-connection operation is actually performed. Thus, the hoods or boots 58 of the bridges serve both to provide lead-ins for the wires 62(*a*)–62(*e*) and retain the wires in place in anticipation of connection to the connectors in the block. The wires to be connected to the block will, typically, be lead into the block through the spaces 68 of the fanning strips, and the wires will then be laid in the retention position discussed immediately above with respect to wires 62 of FIG. 1 in anticipation of eventual connection to the wire-formed connector strip 48.

The boots or hoods 58 of the present invention offer a significant improvement over the conductor retaining mechanisms such as the wing retaining elements described in U.S. Pat. No. 4,381,880. The hook-like shape and increased size of the hood or boot 58 performs its intended wire retaining function more positively and more reliably than the wings of U.S. Pat. No. 4,381,880. Also, and very importantly, the hood structure enables the installer to much more rapidly lay and retain the wire in place before insertion and termination with a tool.

The actual mechanical and electrical connection of the conductor of a wires 62(*a*)–62(*e*) to a connector strip will, typically, be effected by means of a wire insertion tool somewhat similar to the general type presently used for inserting wires into "66 Type" connectors of the type shown in U.S. Pat. No. 3,132,913. The boots structure as described may act as an obstruction for commonly used installing tools such as disclosed in application Ser. No. 233,983, now U.S. Pat. No. 4,408,391, filed Feb. 12, 1981 and assigned to the assignee of the present invention. Thus, a tool for use with the boots or hoods 48 of the present invention must be designed in order to avoid contact with the overhanging boots. Mechanical and electrical connection of the conductor of wires 62(*a*)–62(*e*) on individual terminal clip 48 is effected by forcing the wire 62 downwardly between adjacent loops of wire connector 48. The wire 62 will typically be forced down to floor 36. As this happens, the insulation 66 is sheared and adjacent straight sections of the loops of the connector are subsequently urged apart, and generate strong spring return forces, so that firm physical and electrical contact is established between the conductor of wires 62(*a*)–62(*e*) and the adjacent loop surfaces of the wire formed connector. As may also be seen in FIG. 1, and as also discussed above, a particularly useful feature of connectors in accordance with the present invention resides in the fact that two or more conductors may be mounted at a single station in the block. (See wires 62(*a*) and 62(*e*) in FIG. 1).

Referring to FIG. 1, a wire 62(*a*) is shown in position in the row on the right in anticipation of eventual connection to a wire formed connector strip 48. In the position as shown, conductor 62(*a*) has been led in from a fanning strip, positioned along a row 43 between adjacent rows of bridges 38, and is being retained in position by boot 58. Still referring to FIG. 1, conductor 62(*b*) is shown positioned in a retained position after it has been inserted between the boots 58 and an adjoining bridge 38. To the right of conductor 62(*b*) is conductor 62(*c*) which is shown at the bottom of a spaced row 43 after it as been inserted into the wire formed connector 48 and mechanically and electrically connected thereto. Finally, wires 62(*d*) and 62(*e*) are shown mounted in a single station as discussed above.

While a preferred embodiment has been shown and described, various modifications and substitutions may be made thereto without departing from the sprit and scope of the invention. Accordingly, it is to be understood that the present invention has been described by way of illustration and not limitation.

What is claimed is:

1. A block for housing connector elements formed from electrically conductive stock of circular cross-section, the block including:

a retainer section;

a plurality of spaced slots in said retainer section;

a main body section;

a plurality of spaced slots in said main body section, said body section slots each being in alignment with a corresponding slot in said retainer section;

a plurality of bridge elements on said main body section, said bridge elements each being in alignment with a main body section slot, each bridge element defining a passage in registration with the main body section slot with which it is aligned;

said corresponding retainer section slots, main body section slots and bridge element passages cooperating to define housings for connector elements of the type formed from electrically conductive stock of circular cross-section;

the bridge elements which are in alignment with each slot being spaced apart and being in alignment with the bridge elements which are in alignment with other body section slots to define spaced columns which guide electrical conductors to connector elements of the type formed from electrically conductive stock of circular cross-section which are to be inserted in said block;

at least one boot at the top of at least one bridge element, said boot overhanging the top of an adjoining bridge element, said boot having a hook shape and being spaced above each connector element; and means for releasably joining said retainer section to said main body section.

2. A block as in claim 1 wherein:

said boot on said bridge element cooperates with an adjoining bridge to define a lead-in area for insertion of an electrical conductor.

3. A block as in claim 2 wherein:

said boot cooperates with an adjoining bridge to define retaining means to retain an electrical conductor therebetween prior to connection to a wire conductor of the type formed from electrically conductive stock of circular cross-section.

4. A block as in claim 1 wherein:

said boot cooperates with an adjoining bridge to define retaining means to retain an electrical conductor therebetween prior to connection to a wire conductor of the type formed from electrically conductive stock of circular cross-section.

5. A block as in claim 1 wherein:

said boot has a tip which points inwardly toward the center of said block.

* * * * *